US007418224B2

(12) United States Patent
Gross et al.

(10) Patent No.: US 7,418,224 B2
(45) Date of Patent: Aug. 26, 2008

(54) COROTRON PIN GUARD

(75) Inventors: Robert A. Gross, Penfield, NY (US); David Sekovski, Rochester, NY (US); Douglas A. McKeown, Geneseo, NY (US); David K. Ahl, Rochester, NY (US); Michael N. Soures, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 409 days.

(21) Appl. No.: 11/265,478

(22) Filed: Nov. 2, 2005

(65) Prior Publication Data

US 2007/0098446 A1 May 3, 2007

(51) Int. Cl.
*G03G 15/02* (2006.01)

(52) U.S. Cl. ..... 399/173; 399/170; 399/171; 399/172

(58) Field of Classification Search ..... 399/170–173; 361/211, 230; 250/324, 321
See application file for complete search history.

(56) References Cited

U.S. PATENT DOCUMENTS 5,229,819 A 7/1993 Beresniewicz et al.
5,909,608 A * 6/1999 Manno et al. ..... 399/173

* cited by examiner

*Primary Examiner*—David M. Gray
*Assistant Examiner*—Ryan D Walsh

(57) ABSTRACT

An improved coronode assembly includes pin guards that are positioned closely spaced from and extending above a coronode in order to provide protection for a user reaching past the coronode to remove a sheet jam, and prevent coronode damage when the coronode is handled during servicing by a field service technician. The closeness of the pin guards to the coronode also serves to produce a more uniform field.

3 Claims, 3 Drawing Sheets

COROTRON PIN GUARD

This invention relates in general to an image forming apparatus and more particularly, to an improved pin corotron apparatus that reduces the potential for injury during jam clearance and prevents coronode damage when the pin corotron is handled during servicing by a field service technician.

Electrostatographic copying is executed by exposing a light image of an original document to a substantially uniform charged photoreceptive member. Exposing the charge photoreceptive member to a light image discharges the photoconductive surface thereof in areas corresponding to non-image areas in the original document, while maintaining the charge of image areas to create an electrostatic latent image of the original document on the photoreceptive member. The electrostatic latent image is subsequently developed into a visible image by a process in which a charged developing material is deposited onto the photoconductive surface of the photoreceptor such that the developing material is attracted to the charged image areas thereon. The developing material is then transferred from the photoreceptive member to a copy sheet on which the image may be permanently affixed to provide a reproduction of the original document. In a final step, the photoconductive surface of the photoreceptive member is cleaned to remove any residual developing material therefrom in preparation for successive imaging cycles.

This process is useful for light lens copying from an original, as well as, for printing documents from electronically generated or stored originals. Analogous processes also exist in other electrostatographic applications, such as, for example, iconography where charge is selectively deposited on a charge retentive surface in accordance with an image stored in electronic form.

Electrostatographic imaging machines often use corona devices for providing consisting of an array of sharp pins for providing electrostatic fields to drive various machine operations. Such corona devices are primarily used to deposit charge on the photoreceptive member prior to exposure to the light image for subsequently enabling toner transfer thereto. In addition, corona devices are used in the transfer of an electrostatic image from a photoreceptor to a transfer substrate, in tacking and detacking paper to or from the imaging member by applying a neutralizing charge to the paper, and, generally, in conditioning the imaging surface prior to, during, and after toner is deposited thereon to improve the quality of the xerographic output copy. If a copy sheet conveyed through the machines jams in the area of the corotrons, a potential hazard is presented to an operator when the requirement is presented to reach into the machine past the corotrons to remove the sheets. For example, to improve jam clearance in some current machines, the transfer deck needs to be pivoted further away from the photoreceptor. However, this creates a potential safety hazard. When the operator lifts the transfer deck and reaches in to remove a copy sheet an injury could occur if the operator contacts the sharp detack pin array.

One attempt at solving this problem is shown in U.S. Pat. No. 5,229,819 by Jon M. Beresniewicz et al. issued Jul. 20, 1993, which is incorporated by reference herein to the extent necessary to practice the present disclosure including the references cited therein. This patent describes a corotron assembly that includes a coronode for generating an electrostatic field and also includes an electrically nonconductive protective guard having a U-shaped base member forming a channel for receiving the coronode. A plurality of finger elements are provided, extending from the sidewalls such that the coronode is recessed between the finger elements. Each finger element is further provided with a spherical radii tip for reducing the attenuating effects of the finger elements on the electrostatic field generated by the coronode. This device was quite a safety improvement over previous corotron assemblies in preventing injury to operators during removal of copy sheet jams, but there is still presented the possibility for injury to occur to operators with thin fingers. Obviously, there is still a need for a pin corotron assembly that will allow access to copy sheet jams while minimizing the potential safety hazards and prevent coronode damage when the pin corotron is handled during servicing by a field service technician.

Accordingly, an improved corotron assembly is disclosed that minimizes the potential for operator injury when removing copy sheet jams at the corotron assembly by mounting safety guards closer to the pin array so that it will be more difficult for the operator or field service technician to come into contact with the pin array. A concomitant improvement is a more uniform corona generation.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
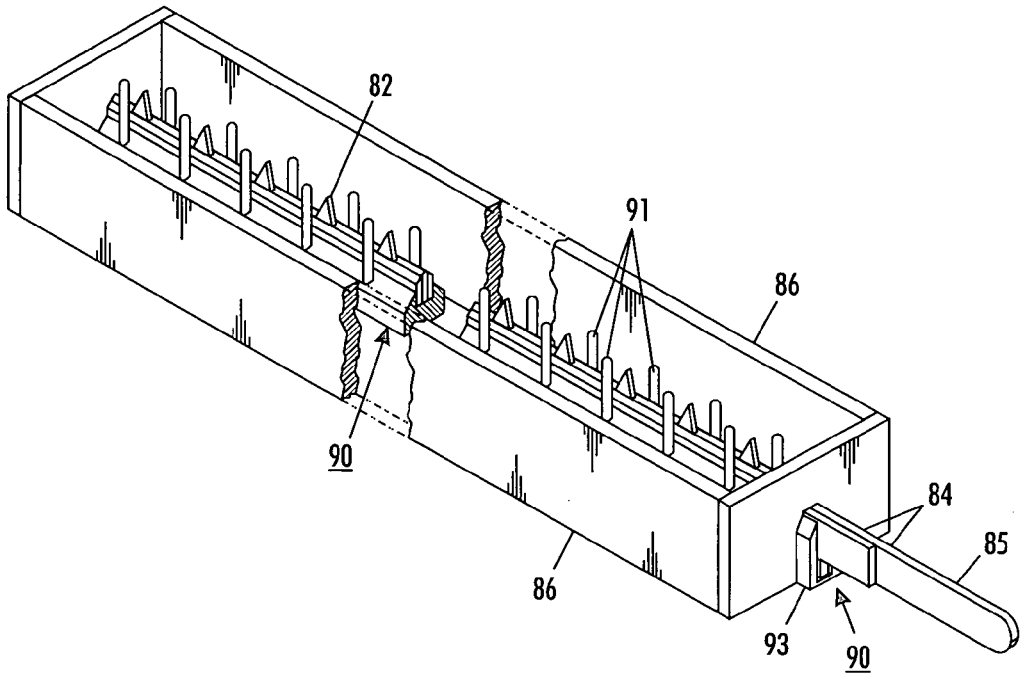
FIG. 1 PRIOR ART
FIG. 1 is a perspective view of a prior art corona generating device.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved corona generating device.

For a general understanding of the features of the disclosure, reference is made to the drawings. In the drawings, like reference numerals have been used throughout to identify identical elements.

Figure 3:
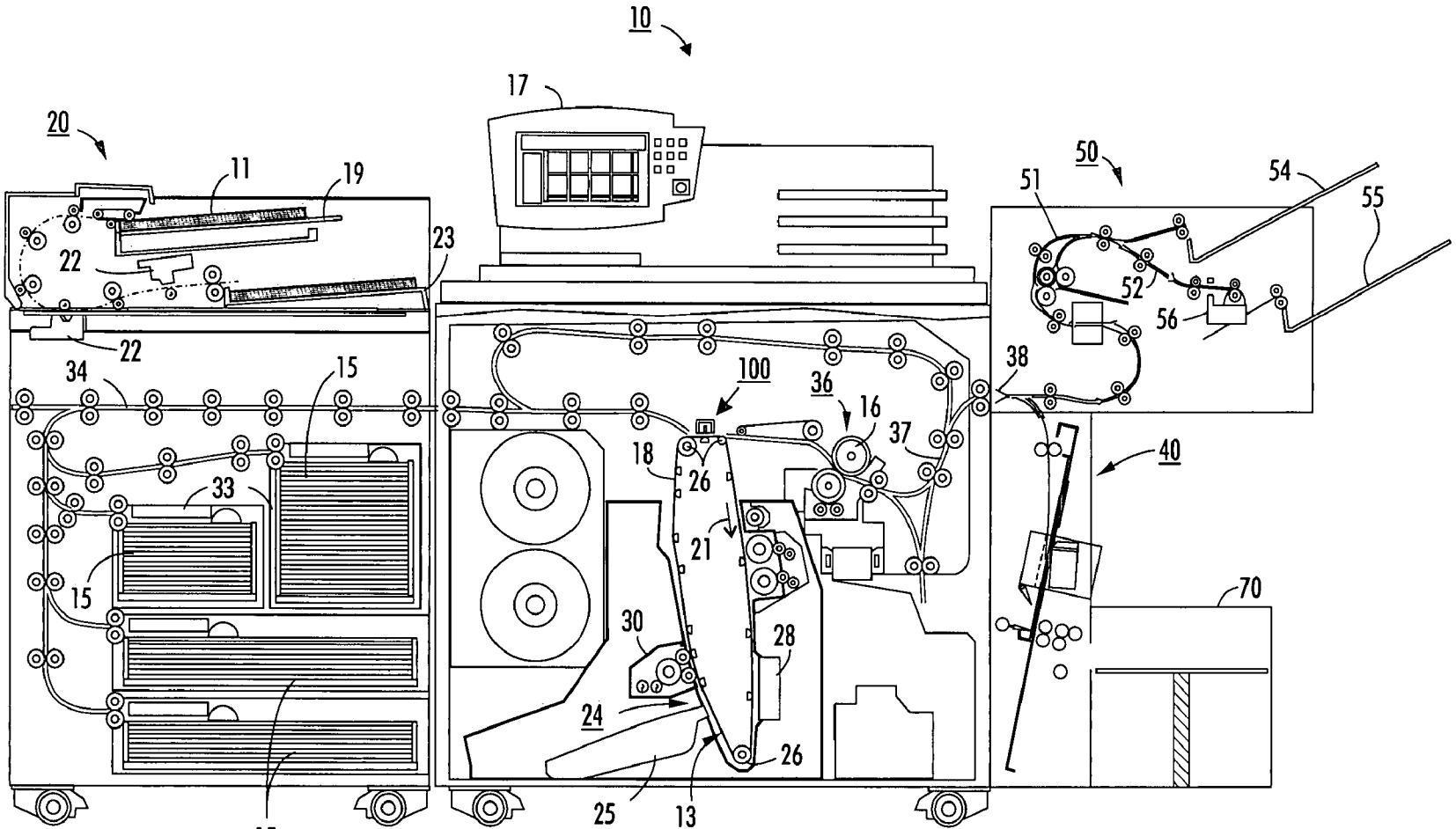
FIG. 3 is an exemplary elevation view of a modular xerographic printer that includes an exemplary corona generating device in accordance with the present disclosure.

Referring to the FIG. 3 printer 10, as in other xerographic machines, and as is well known, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toned image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to be utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and a detack corotron 90 in accordance with the present disclosure at transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to a multi-function finishing station 60.

With further reference to FIG. 3, a simplified elevation view of multi-functional finisher 50 is shown including a modular booklet maker 40. Printed signature sheets from the printer 10 are accepted at an entry port 38 and directed to multiple paths and output trays for printed sheets, corresponding to different desired actions, such as stapling, hole-punching and C or Z-folding. It is to be understood that various rollers and other devices which contact and handle sheets within finisher module 50 are driven by various motors, solenoids and other electromechanical devices (not shown), under a control system, such as including a microprocessor (not shown), within the finisher module 50, printer 10, or elsewhere, in a manner generally familiar in the art.

Multi-functional finisher 50 has a top tray 54 and a main tray 55 and a folding and booklet making section 40 that adds stapled and unstapled booklet making, and single sheet C-fold and Z-fold capabilities. The finished booklets are then collected in a stacker 70. The top tray 54 is used as a purge destination, as well as, a destination for the simplest of jobs that require no finishing and no collated stacking. The main tray 55 has a pair of pass-through 100 sheet upside down staplers 56 and is used for most jobs that require stacking or stapling, and the folding destination 40 is used to produce signature booklets, saddle stitched or not, and tri-folded. Sheets that are not to be C-folded, Z-folded or made into booklets or do not require stapling are forwarded along path 51 to top tray 54. Sheets that require stapling are forwarded along path 52, stapled with staplers 56 and deposited into the main tray 55. Conventional, spaced apart, staplers 56 are adapted to provide individual staple placement at either the inboard or outboard position of the sheets, as well as, the ability for dual stapling, where a staple is placed at both the inboard and outboard positions of the same sheets.

Figure 2:
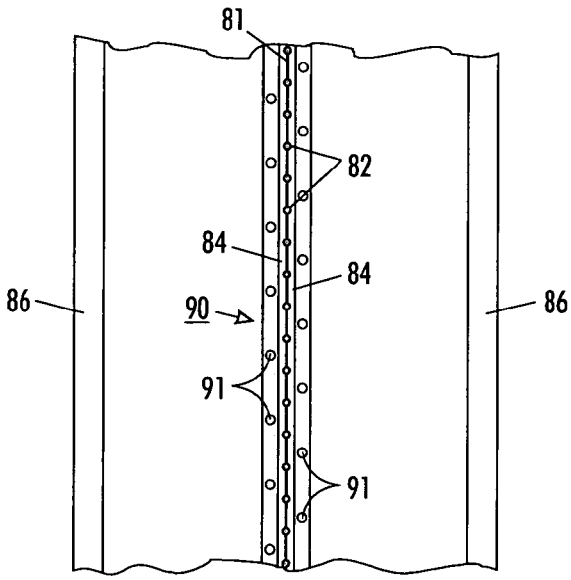
FIG. 2 PRIOR ART
FIG. 2 is a side view of the prior art corona generating device of FIG. 1.

FIGS. 1 and 2 illustrate prior art configurations of a pin coronode device that comprises a pin coronode 81 including a pin array 82, supported by side support members 84 and positioned between shield member 86. Pin coronode 81 coupled to a high voltage extension member 85, comprises a thin, elongated member fabricated from a highly conductive material having triangular teeth or scalloped edges along one edge thereof and extending the entire length of the member towards a surface to be charged.

Pin coronode 81 is coupled to a high-voltage extension member 85. Typically, the pin coronode 81 has a thickness of approximately 0.08 mm (0.003 inches) and the teeth of pin array 82 extend approximately 3.5 mm (0.136 inches) from the top edge of the side support member 84 at a pin tip to pin tip interval of approximately 3 mm (0.12 inches). An electrical nonconductive protective guard 90 includes a base member 93 forming an open-ended aperture having fingers 91 extending therefrom. Base member 93 is generally U-shaped, having a pair of opposed sidewalls and is substantially equal to the combined thickness of pin coronode 81 and side support members 84 so as to receive the coronode 81 and side support members 84 in the aperture thereof and provide a close fitting arrangement therein. A plurality of spaced finger-shaped projections 91 extends from base 93 substantially parallel to pin array 82 of pin coronode 81.

As seen in FIG. 1, the finger-shaped projections 91 of protective guard 90 extend beyond the height of the pin array 82 such that the pin array 82 is recessed within the protective guard 90. Since the pin array 82 is recessed between the finger elements 91 of the protective guard 90 this is a step toward preventing external contact with the pin array during handling of the corona generating assembly. Even though this protective guard serves to prevent some lacerations to a field technician or other person and also serves to prevent damage to the projections of the pin array, it is still possible to sustain an injury when trying to clear a paper jam from an area that includes a corona generating device. The finger shaped projections 91 of the protective guard 90 extend approximately 1 mm above the projections of pin array 82. Each finger element 91 is approximately 1 mm in diameter and spaced approximately 6 mm from one another, on center.

Figure 4:
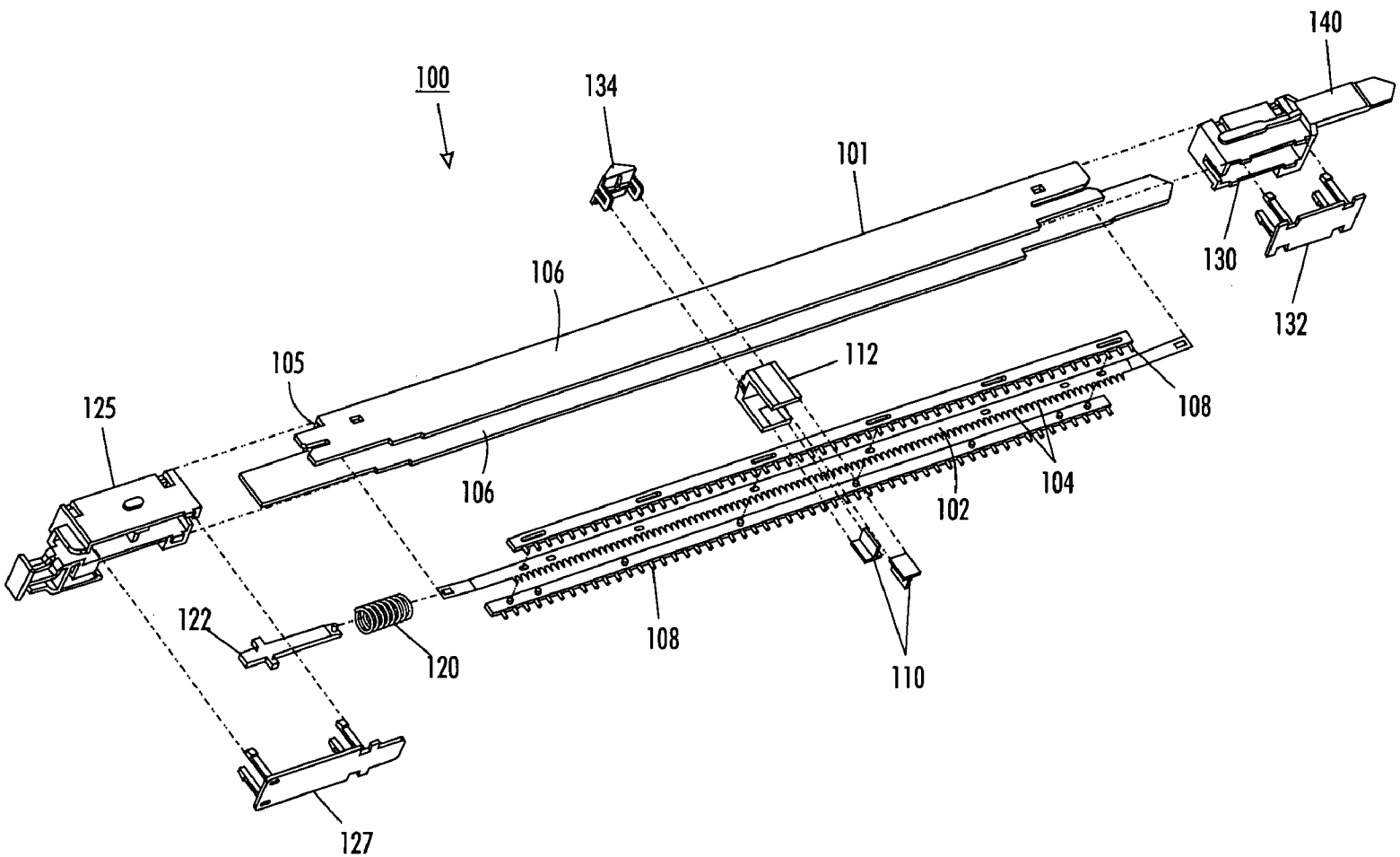
FIG. 4 is an expanded perspective view of the corona generating device of the present disclosure.

Referring now more particularly to FIG. 4, an exemplary corona charging device representative of the specific subject matter of the present disclosure is illustrated and will be described in greater detail that is more robust for safety, more compact, easier to manufacture and is less costly because it has fewer parts than the prior art corona device of FIGS. 1 and 2. The primary components of corona charging assembly 100 is pin coronode 102 having a pin array 104 mounted within a U-shaped shield member 101 having sides 106. Pin array 104 includes an array of integral coplanar projections extending along an edge of pin coronode 102. Plastic pin array guards 108 include a plurality of finger-shaped projections with the electrically conductive coronode 102 being positioned within and below tips of the finger-shaped projections that are snapped directly onto a lower portion of pin array 104 with about a 0.1 mm clearance between the pin array and the finger-shaped projections of the guards, whereas the pin array guards heretofore were housed in a separate housing and spaced a significant distance away from the pin array as shown in FIGS. 1 and 2. It has been found that positioning the pin array guards 108 within about 0.1 mm of contact with the pin coronode 102 makes it safer or more difficult to accidentally touch the pins and get injured while, for example, clearing a sheet jam in the area of the coronode. This design has also shown to generate a more uniform field.

Brushes 110 mounted within yoke 112 are pressed against pin array guards 108. With pin array guards 108 being mounted closely spaced from coronode 102, the use of brushes 110 as an automatic pin array coronode cleaner is realized. Further, because of this feature, the pin array can withstand a greater normal force without deflection. A carriage 134 that is positioned on a bottom surface 105 of the U-shaped shield member 101 within sides 106 supports yoke 112.

A compression spring 120 is connected to the outboard end of coronode 102 and outboard end block 125 with the use of a tension holder 122 and outboard cover 127. Compression spring 120 provides tautness and stiffness to the pin array. While a compression spring is shown, the disclosure is not limited to compression springs since other springs could be use, for example, leaf springs. The inboard end of coronode 102 is mounted within inboard end block 130 and cover 132. Pin coronode 102 is preferably connected to a high-voltage extension member 140, or alternatively may be provided with an integral high-voltage extension member for electrical connection of the pin coronode 102 to a high-voltage power source (not shown). In addition, the clamping of the pin array guards 108 to the pin array 104 allows the pin array to float and be located by outboard and inboard end blocks 125 and 130, respectively.

It should now be understood that an improved corona generating assembly had been disclosed wherein a pin corona thereof is sandwiched between a protective guard having a plurality of protective finger elements extending to a height which is greater than the height of projections of the pin coronode. The protective guards are placed within about 0.1 mm contact with the pin coronode in order to generate a more uniform field and to make it more difficult to accidentally touch the pins and get injured. This design applies to any pin array corona emitting device, such as, corotrons and static eliminations.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device including a coronode apparatus improved for safety and performance, comprising:

a unitary, single piece, electrically conductive coronode adapted to generate ions, said electrically conductive coronode having a thickness of approximately 0.08 mm; and electrically non-conductive protective guards having a first portion thereof touching opposite sides of said electrically conductive coronode, and a second portion thereof that includes finger shaped projections extending therefrom, said finger shaped projections are adapted so that the spacing between said finger shaped projections is only about 0.2 mm plus the thickness of the narrow coronode itself, in order to reduce the potential for injury during jam clearance of the reprographic device in the location of said electrically conductive coronode and increase ion generation uniformity from said electrically conductive coronode.

2. The reprographic device of claim 1, including a U-shaped shield member adapted to support said electrically conductive coronode, said shield member including a yoke member mounted therein and brushes mounted within said yoke member and pressed against said non-conductive protective guards so that with said finger shaped projections of said non-conductive protective guards being positioned so closely spaced from said electrically conductive coronode, said electrically conductive coronode is automatically cleaned when it is removed from or inserted into said shield member.

3. The reprographic device of claim 2, including outboard and inboard end blocks and a spring adapted to mount said electrically conductive coronode within said U-shaped shield member, and wherein said non-conductive protective guards are clamped to said electrically conductive coronode to allow said electrically conductive coronode to float and be located by said outboard and inboard end blocks.

* * * * *